US008710812B1

(12) United States Patent
Edwards

(10) Patent No.: US 8,710,812 B1
(45) Date of Patent: Apr. 29, 2014

(54) REGULATING A SUPPLY VOLTAGE PROVIDED TO A LOAD CIRCUIT

(75) Inventor: Eric E. Edwards, Albuquerque, NM (US)

(73) Assignee: Xilinx, Inc., San Jose, CA (US)

( * ) Notice: Subject to any disclaimer, the term of this patent is extended or adjusted under 35 U.S.C. 154(b) by 972 days.

(21) Appl. No.: 12/360,258

(22) Filed: Jan. 27, 2009

(51) Int. Cl.
*G05F 1/00* (2006.01)

(52) U.S. Cl.
USPC ..... 323/281; 323/311; 323/313; 323/907

(58) Field of Classification Search
USPC ..... 323/273–275, 281, 311–314, 907
See application file for complete search history.

(56) References Cited

U.S. PATENT DOCUMENTS 4,825,142 A * 4/1989 Wang ..... 323/314
5,025,248 A * 6/1991 Bergeron ..... 340/596
5,239,255 A * 8/1993 Schanin et al. ..... 323/237
6,005,376 A * 12/1999 Mett et al. ..... 323/281
6,141,193 A * 10/2000 Mercer ..... 361/18
6,492,874 B1 * 12/2002 Shih ..... 330/288
7,307,468 B1 * 12/2007 Vasudevan ..... 327/539
7,598,710 B2 * 10/2009 Zhang ..... 320/137
2003/0164697 A1 * 9/2003 Hardie ..... 324/207.15
2003/0174004 A1 * 9/2003 Kamel et al. ..... 327/170
2004/0008013 A1 * 1/2004 Gay ..... 323/273
2005/0218991 A1 * 10/2005 Birbeck ..... 330/296
2007/0252573 A1 * 11/2007 Tachibana et al. ..... 323/313

* cited by examiner

*Primary Examiner* — Gary L Laxton
*Assistant Examiner* — Gustavo Rosario Benitez
(74) *Attorney, Agent, or Firm* — Terry W. Forsythe; LeRoy D. Maunu; Lois D. Cartier

(57) ABSTRACT

A method of regulating a supply voltage ($V_{gg}$) provided to a load circuit. The method can include generating at least one reference voltage ($V_{r1}$, $V_{r2}$, $V_{r3}$) having a negative voltage-temperature coefficient. The method further can include applying the reference voltage as a bias voltage ($V_{bias}$) to a current sink that is electrically coupled in parallel with a path of a leakage current ($I_{leak}$) drawn by the load circuit. A related voltage regulator can include a current sink that is electrically coupled in parallel with a path of a leakage current drawn by a load circuit, and a bias control circuit that generates at least one reference voltage having a negative voltage-temperature coefficient and applies the reference voltage as a bias voltage to a current sink.

16 Claims, 6 Drawing Sheets

REGULATING A SUPPLY VOLTAGE PROVIDED TO A LOAD CIRCUIT

FIELD OF THE INVENTION

The embodiments disclosed herein relate to voltage regulators, sometimes also referred to as power-supply regulators. More particularly, the embodiments relate to the regulation of a supply voltage provided to a load circuit.

BACKGROUND

Voltage regulators are often used to provide an internal supply voltage to integrated circuits. Voltage regulators are typically designed to provide an adequate load current for the operation of a load circuit while at the same time providing a stable voltage to the integrated circuits. The integrated circuits whose power is supplied by the voltage regulator are oftentimes referred to as "load circuits" or, more simply, "loads."

When in operation, each load connected to a voltage regulator typically draws a leakage current. Leakage current is the flow of current through unintended paths, for example through insulation layers within a load that have finite values of insulation resistance. In this regard, the total load current supplied to loads generally includes both the current drawn by the loads during normal operation and by leakage current of the loads.

One example of a load is a memory cell array, although any of a myriad of other circuit components may constitute a load. Although the amount of leakage current through each memory cell within a memory cell array is rather small, when thousands of memory cells are used within a memory cell array, the total leakage current of the memory cell array can become significant. Moreover, the amount of leakage of the memory cell array can vary depending on the operating temperature of the memory cell array.

Referring to FIG. 1, a chart 100 is depicted which presents an example plot 102 of the leakage current of a memory cell array vs. temperature, as well as other plots 104, 106 which will be described. It should be noted that the temperature values presented on the horizontal axis and the current values presented on the vertical axis are merely for explanatory purposes within the context of the present example. The respective scales may vary for different memory cell array implementations. Nonetheless, as depicted by the plot 102, the leakage current $I_{leak}$ drawn by a typical load has a positive current-temperature coefficient. In other words, the amount of leakage current drawn by a load generally increases as the temperature of load increases. For example, the leakage current $I_{leak}$ drawn when the load is very cold (e.g., −50° C.) can be very close to 0, but increase exponentially as the temperature of the load increases.

The variation in the amount of leakage current $I_{leak}$ that is drawn by the load presents an issue when trying to maintain a stable supply voltage over a broad range of temperatures. Specifically, if the voltage regulator is designed to provide the proper supply voltage at a low temperature when the total current drawn by a load (i.e., operating current+leakage current $I_{leak}$) is low, the voltage regulator can become unstable, resulting in oscillations in the supply voltage. On the other hand, if the voltage regulator is designed to provide the proper supply voltage at a high temperature when the leakage current $I_{leak}$ is at its maximum, the total power drawn from the voltage regulator may be well above the target power consumption level.

In one known voltage regulator, the temperature variation issue is addressed using an n-channel MOSFET (NMOS) transistor (commonly referred to as a "leaker") that is electrically connected to the supply voltage in parallel with a load. This transistor will draw additional load current $I_{NMOS}$, for example as depicted in plot 104, from the voltage regulator when the total current drawn by a load is insufficient to keep the voltage regulator in stable operation, for example when the load is cold (e.g., −50° C.), and thus the leakage current $I_{leak}$ is low, while the operating current also is low.

As noted, the leakage current $I_{leak}$ of the load circuit generally increases exponentially with temperature. The load current drawn by the NMOS transistor also increases with temperature, but generally increases linearly. In consequence, the use of the NMOS transistor results in a greater total current $I_{total}$, for example as depicted in plot 106, than is necessary when the load is at a normal operating temperature, and thus increases power losses.

SUMMARY

The embodiments disclosed herein relate to the regulation of a supply voltage provided to a load circuit. One embodiment of the present invention can include a method of regulating a supply voltage provided to a load circuit. The method can include generating at least one reference voltage having a negative voltage-temperature coefficient. The method further can include applying the reference voltage as a bias voltage to a current sink that is electrically coupled in parallel with a path of a leakage current drawn by the load circuit. Generating at least one reference voltage having the negative voltage-temperature coefficient can include generating a plurality of reference voltages and selecting the at least one reference voltage from the plurality of reference voltages.

Applying the reference voltage to a current sink as a bias voltage can include applying the reference voltage to an n-channel MOSFET transistor. Applying the reference voltage to the current sink as the bias voltage can include indicating to the current sink to draw a current from a voltage supply in order to maintain a total current supplied by the voltage supply within a suitable operating range of the voltage supply.

Drawing current from the voltage supply to maintain the total current supplied by the voltage supply within the suitable operating range of the voltage supply can include drawing the current to exhibit a negative current-temperature coefficient. The total current supplied by the voltage supply can be approximately equal to the current drawn by the current sink and the leakage current drawn by the load circuit. Further, the reference voltage applied to the current sink as a bias voltage can be turned off when the load circuit has reached a suitable operating temperature.

Another embodiment of the present invention can include a voltage regulator. The voltage regulator can include a current sink that is electrically coupled in parallel with a path of a leakage current drawn by a load circuit, and a bias control circuit that generates at least one reference voltage having a negative voltage-temperature coefficient and applies the reference voltage as a bias voltage to a current sink. The bias control circuit can include a voltage selector that selects the at least one reference voltage from a plurality of reference voltages. The current sink can include an n-channel MOSFET transistor.

The reference voltage can indicate to the current sink to draw a current from a voltage supply in order to maintain a total current supplied by the voltage supply within a suitable operating range of the voltage supply. The current can be drawn to exhibit a negative current-temperature coefficient. The total current supplied by the voltage supply can be approximately equal to the current drawn by the current sink and the leakage current drawn by the load circuit. The bias control circuit can turn off the reference voltage applied to the current sink as a bias voltage when the load circuit has reached a suitable operating temperature.

The bias control circuit further can include at least one circuit selected from the group consisting of a Schmidt trigger and a comparator. The voltage regulator further can include a voltage gain amplifier that increases or decreases the reference voltage.

The voltage regulator also can include a voltage offset circuit that applies an offset voltage to the reference voltage to generate a voltage offset, a p-channel MOSFET transistor that generates a temperature voltage, and an inverter that inverts the temperature voltage and adds to the temperature voltage the offset voltage to generate the bias voltage. The bias voltage can have a negative voltage-temperature coefficient.

The voltage regulator also can include a voltage supply that supplies a supply voltage to the load circuit. Further, the bias control circuit can include a reference circuit.

DETAILED DESCRIPTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting, but rather to provide an understandable description of the invention.

The embodiments disclosed herein relate to the regulation of a supply voltage provided to a load circuit. More particularly, the embodiments disclosed herein relate to controlling the amount of current that is drawn through a current sink, which is electrically coupled to the supply voltage in parallel with the path of leakage current drawn by the load circuit. To control the draw of current through the current sink, a selected reference voltage may be applied to the current sink as a bias voltage. In one embodiment, the reference voltage can have a negative voltage-temperature coefficient. Thus, the current drawn through the current sink can decrease as the temperature of the load circuit increases. Accordingly, in comparison to the prior art, the percentage of increase between minimum and maximum current drawn from the supply voltage can be reduced, thereby reducing the total power drawn by the load circuit and the current sink at any given temperature within a given window of operating temperatures. Moreover, the current sink still can provide enough load current to ensure that the voltage regulator system remains stable at any given temperature within a given window of operating temperatures.

The present invention can be implemented in any of a variety of systems that use load circuits. For example, the present invention can be implanted within an integrated circuit (IC). One example of such an IC is a programmable IC. The phrase "programmable IC," as used within this specification includes devices that are fully programmable as well as those that are only partially programmable. One example of a programmable IC is a field programmable gate array (FPGA). Other types of programmable ICs may be utilized with the embodiments disclosed within this specification. Such devices can include, for example, complex programmable logic devices (CPLDs), programmable logic arrays (PLAs), and programmable array logic (PAL) devices.

Figure 1:
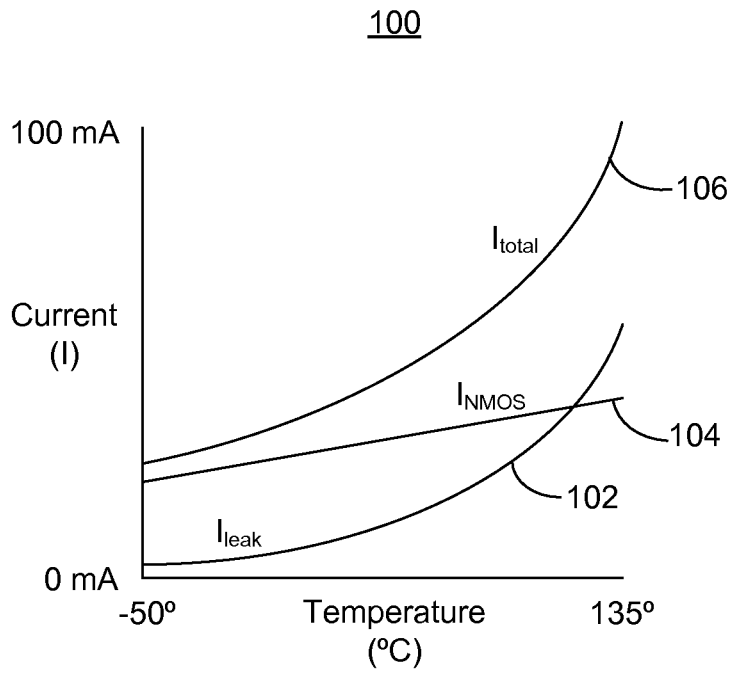
FIG. 1 (Prior Art)
FIG. 1 is a first chart depicting plots of current vs. temperature which is useful for understanding the prior art.
Figure 2:
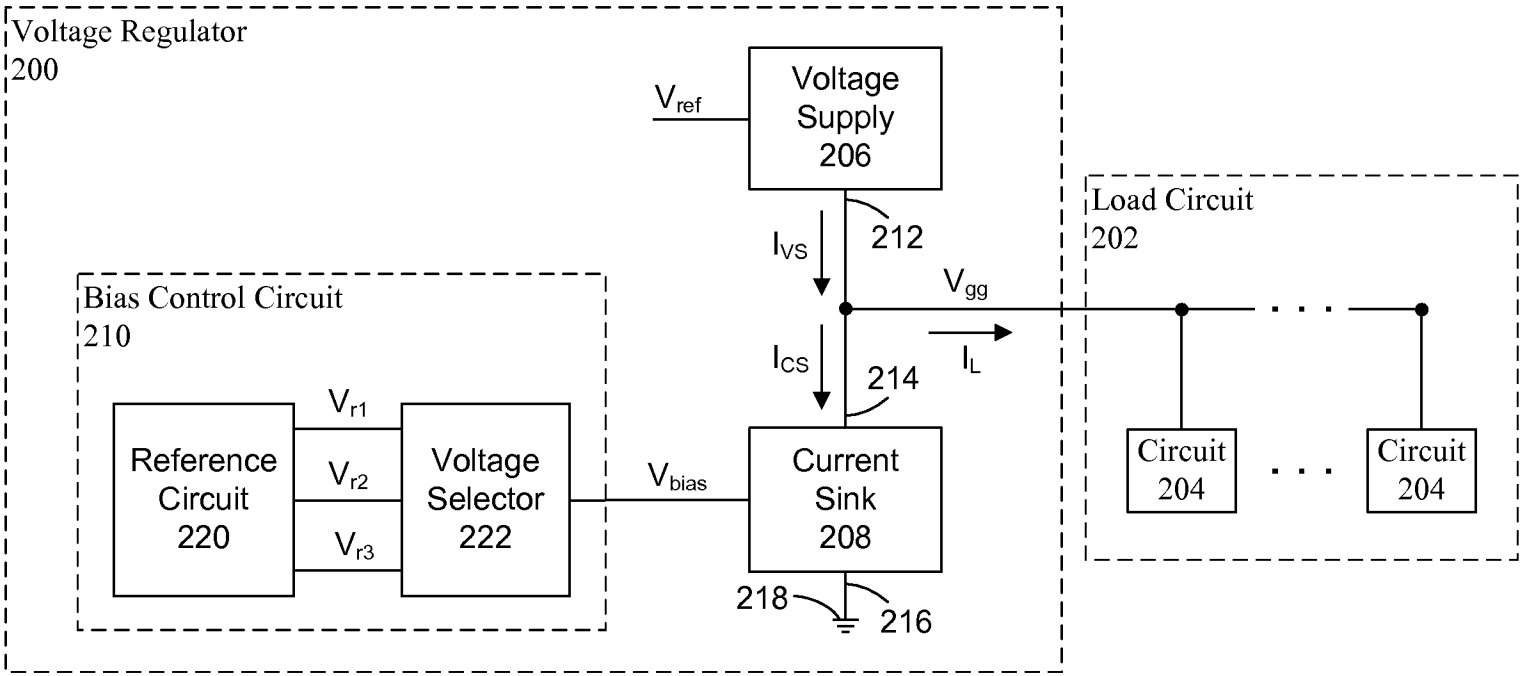
FIG. 2 is a first block diagram illustrating a voltage regulator in accordance with an embodiment of the present invention.

FIG. 2 is a block diagram illustrating a voltage regulator 200 in accordance with an embodiment of the present invention. The voltage regulator 200 can provide a supply voltage $V_{gg}$ to a load circuit 202 comprising a plurality of circuits 204. In one embodiment, the voltage regulator 200 can include a voltage supply 206. The voltage supply 206 can receive a reference voltage $V_{ref}$ and, based on the reference voltage $V_{ref}$, output the supply voltage $V_{gg}$. In one embodiment, the supply voltage $V_{gg}$ can be equal to, or approximately equal to, the reference voltage $V_{ref}$. In another embodiment, a gain can be applied to the reference voltage $V_{ref}$ to generate the supply voltage $V_{gg}$. For instance, if $V_{gg}$ is less than $V_{ref}$, a voltage gain of less than one can be applied to $V_{ref}$. If $V_{gg}$ is greater than $V_{ref}$, a voltage gain of greater than one can be applied to $V_{ref}$.

In another embodiment, the voltage supply 206 can be external to the voltage regulator 200. For instance, the supply voltage $V_{gg}$ can be provided by another device within a system in which the voltage regulator 200 is implemented. The voltage supply 206 also can be external to such system. In illustration, the voltage supply 206 can be an external component which provides the supply voltage $V_{gg}$ to the voltage regulator 200 via a suitable input port.

As noted, the load circuit 202 may draw a leakage current $I_L$ that varies with temperature. To stabilize the voltage $V_{gg}$ output by the voltage supply 206 with respect to temperature, an input 214 of the current sink 208 can be coupled to the output 212 of the voltage supply 206 and an output 216 of the current sink 208 can be coupled to a suitable ground 218. In this regard, the current sink 208 can be electrically coupled in parallel with the path of the leakage current $I_L$ drawn by the load circuit 202. Moreover, the total current $I_{vs}$ output by the voltage supply 206 can be approximately equal to the sum of the leakage current $I_L$ and the current $I_{CS}$ drawn by the current sink 208. Accordingly, if the leakage current $I_L$ of the load circuit 202 is low due to the load circuit 202 being below operating temperature, the additional load circuit of current $I_{CS}$ drawn by the current sink 208 can maintain the total current $I_{VS}$ supplied by the voltage supply 206 within a suitable operating range of the voltage supply 206.

The current $I_{CS}$ drawn by the current sink 208 need not be drawn to exhibit a positive current-temperature coefficient. Indeed, the current $I_{CS}$ can be drawn to exhibit a zero current-temperature coefficient or a negative current-temperature coefficient. As used herein, the term "current-temperature coefficient" means a coefficient that defines a level of current drawn vs. temperature. For example, when the current $I_{CS}$ is drawn to exhibit a positive current-temperature coefficient, the level of current $I_{CS}$ will generally increase as temperature increases. When the current $I_{CS}$ is drawn to exhibit a zero current-temperature coefficient, the level of current $I_{CS}$ will be maintained relatively constant with respect to temperature. When the current $I_{CS}$ is drawn to exhibit a negative current-temperature coefficient, the level of current $I_{CS}$ will generally decrease as temperature increases.

The current $I_{CS}$ drawn by the current sink 208 can be controlled by a bias voltage $V_{bias}$ provided by the bias control circuit 210. For example, if it is desired for the current $I_{CS}$ to have a positive current-temperature coefficient, the bias control circuit 210 can select the bias voltage $V_{bias}$ to have a positive voltage-temperature coefficient. Similarly, if it is desired for the current $I_{CS}$ to have a zero current-temperature coefficient, the bias control circuit 210 can select the bias voltage $V_{bias}$ to have a zero voltage-temperature coefficient. Moreover, if it is desired for the current $I_{CS}$ to have a negative current-temperature coefficient, the bias control circuit 210 can select the bias voltage $V_{bias}$ to have a negative voltage-temperature coefficient. As used herein, the term "voltage-temperature coefficient" means a coefficient that defines a level of voltage vs. temperature. For example, when the bias voltage $V_{bias}$ has a positive voltage-temperature coefficient, the level of bias voltage $V_{bias}$ will generally increase as temperature increases. When the bias voltage $V_{bias}$ has a zero voltage-temperature coefficient, the level of bias voltage $V_{bias}$ will be maintained relatively constant with respect to temperature. When the bias voltage $V_{bias}$ has a negative voltage-temperature coefficient, the level of bias voltage $V_{bias}$ will generally decrease as temperature increases.

The bias control circuit 210 can include a reference circuit 220. In one embodiment, the reference circuit 220 can comprise a band-gap reference circuit, although the invention is not limited in this regard. The reference circuit 220 can output one or more reference voltages. In this example, three reference voltages are shown, $V_{r1}$, $V_{r2}$, $V_{r3}$, although the number of reference voltages is not limited to three. Indeed, any number of reference voltage can be provided (e.g., less than three or more than three). As used herein, the term "reference voltage" means a voltage that is derived from a voltage of at least one reference device. As used herein, a "reference device" is a device having a voltage-temperature coefficient that is substantially linear and/or a current-temperature coefficient that is substantially linear. In other words, the variance of at least one of the reference voltages with respect to temperature may be approximately linear, as opposed to being, for example, exponential.

Figure 3:
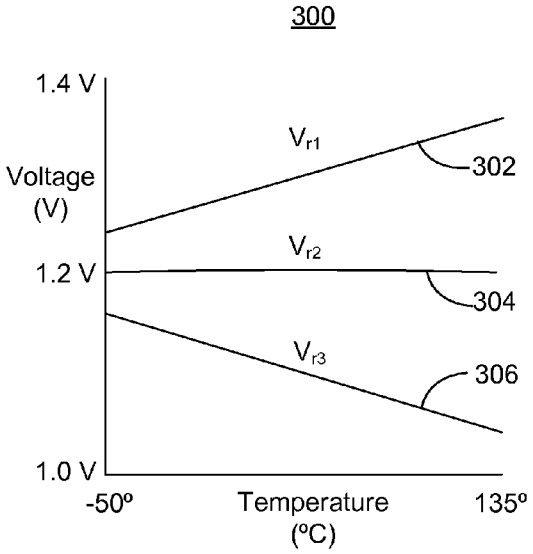
FIG. 3 is a second chart depicting plots of voltage vs. temperature in accordance with an embodiment of the present invention.

The reference voltages $V_{r1}$, $V_{r2}$, $V_{r3}$ may be configured to have positive voltage-temperature coefficients, zero voltage-temperature coefficients, or negative voltage-temperature coefficients. Briefly referring to FIG. 3, a chart 300 is presented which depicts plots 302, 304, 306 of various reference voltages vs. temperature in accordance with an embodiment of the present invention. In the present example, the reference voltage $V_{r1}$ can be configured to have a positive voltage-temperature coefficient as depicted by the plot 302, the reference voltage $V_{r2}$ can be configured to have approximately a zero voltage-temperature coefficient as depicted by plot 304, and the reference voltage $V_{r3}$ can be configured to have a negative voltage-temperature coefficient as depicted by the plot 306. In another embodiment, the reference voltage $V_{r1}$ can be configured to have a zero voltage-temperature coefficient, and the reference voltages $V_{r2}$, $V_{r3}$ each can be configured to have a respective negative voltage-temperature coefficient that is different. Moreover, it should be noted that the reference voltages having positive and negative voltage-temperature coefficients are not limited to the example voltage vs. temperature plots 302-306 depicted in the chart 300, and a myriad of other voltage vs. temperature relationships can be established for the reference voltages $V_{r1}$, $V_{r2}$, $V_{r3}$.

Referring again to FIG. 2, when the reference circuit 220 is configured to output more than one reference voltage $V_{r1}$, $V_{r2}$, $V_{r3}$, a voltage selector 222 can be provided to select at least one reference from among the reference voltages $V_{r1}$, $V_{r2}$, $V_{r3}$ to output as the bias voltage $V_{bias}$. When only one reference voltage (e.g., $V_{r1}$) is desired, however, the voltage selector 222 need not be included in the bias control circuit 210.

The voltage selector 222 can comprise one or more switches, a multiplexer, or any other circuit components suitable for selecting at least one of the reference voltages $V_{r1}$, $V_{r2}$, $V_{r3}$ as the bias voltage $V_{bias}$. In one arrangement, operation of the voltage selector 222 can be controlled by a suitable processor or controller (not shown) that executes suitable computer program code, for instance software and/or firmware.

In operation, the load current of the load circuit typically will increase exponentially with temperature, and the reference voltage $V_{bias}$ may be selected to have a negative voltage-temperature coefficient. Accordingly, the total current drawn by both the current sink and the load circuit can offset one another to maintain a load current $I_L$ that is relatively constant as a function of temperature. Thus, the total power drawn by the load circuit and the current sink can be maintained to be relatively constant as a function of power, rather than increasing as a function of temperature.

Additional embodiments of voltage regulators are presented herein. Throughout this specification like numbers will be used to refer to the same items depicted in various embodiments.

Figure 4:
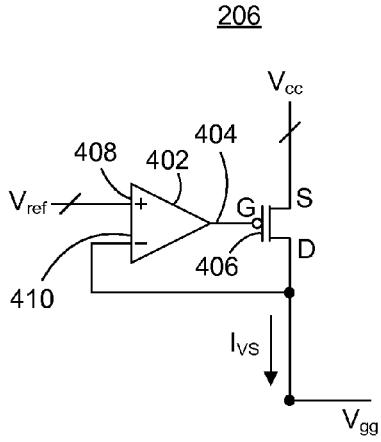
FIG. 4 is a first schematic diagram illustrating a voltage supply in accordance with another embodiment of the present invention.

FIG. 4 is a first schematic diagram illustrating a voltage supply 206 in accordance with another embodiment of the present invention. The voltage supply 206 can include a differential amplifier 402 having an output 404 coupled to a voltage driver 406. In one embodiment, the voltage driver 406 can be a p-channel MOSFET (PMOS) transistor. For example, the output of the differential amplifier 404 can be coupled to a gate of a PMOS transistor. In another embodiment, the voltage driver 406 can be an n-channel MOSFET (NMOS) transistor. Still, any other suitable transistors or other voltage sources may be used and the invention is not limited in this regard. Accordingly, when references to gates, sources and drains are indicated within this specification, it will be appreciated that the inventive arrangements are not limited to these specific structures, and that other structures may be used. For instance, a bipolar junction transistor (BJT) comprises a base, a collector and an emitter, and the use of BJTs are within the scope of the present invention. Moreover, in accordance with the descriptions provided herein, those skilled in the art will appreciate changes to the control signals that may be implemented to accommodate different types of transistors. For example, if an NMOS transistor is used in lieu of a PMOS transistor, the polarity of the control signal applied to the gate of such transistor can be reversed. In this regard, circuit components that provide the control signals can be changed, added or deleted.

The output 404 of the differential amplifier 402 can bias the voltage driver 406. In one embodiment, the voltage driver 406 can be included as a component of the differential amplifier 402, though this need not be the case. A non-inverting input 408 of the differential amplifier 402 can be coupled to the reference voltage $V_{ref}$, and an inverting input 410 of the differential amplifier 402 can be coupled to a drain of the voltage driver 406. Further, a source of the voltage driver 406 can be coupled to a common voltage $V_{cc}$. In one embodiment, the common voltage $V_{cc}$ can be an auxiliary voltage that is supplied to the voltage regulator.

In operation, the differential amplifier 402 can detect the supply voltage $V_{gg}$ generated by the voltage driver 406 at the inverting input 410, thus providing a closed loop control signal that the differential amplifier 402 compares to the reference voltage $V_{ref}$. The differential amplifier 402 then can bias the voltage driver 406 so as to try to maintain an appropriate supply voltage $V_{gg}$. As noted, if the voltage supply current $I_{VS}$ falls below the linear operational range of the voltage driver 406, the current sink can increase the voltage supply current $I_{VS}$.

Figure 5:
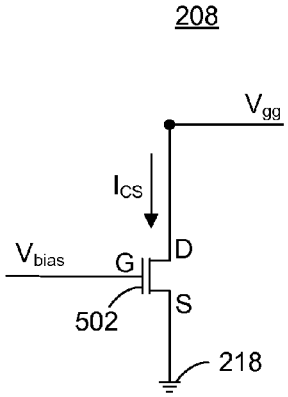
FIG. 5 is a second schematic diagram illustrating a current sink in accordance with another embodiment of the present invention.

FIG. 5 is a second schematic diagram illustrating a current sink 208 in accordance with another embodiment of the present invention. The current sink can include a suitable transistor 502, for example a PMOS transistor, an NMOS transistor, a BJT transistor, etc. In an arrangement in which the transistor 502 is an NMOS transistor, a drain of the transistor 502 can be coupled to the supply voltage $V_{gg}$ output by the voltage supply. For example, the drain of the transistor 502 can be coupled to the drain of the voltage driver. Further, a source of the transistor 502 can be coupled to a suitable ground 218, thus configuring the transistor 502 to be electrically coupled in parallel with the path of the leakage current drawn by the load circuit.

Figure 6:
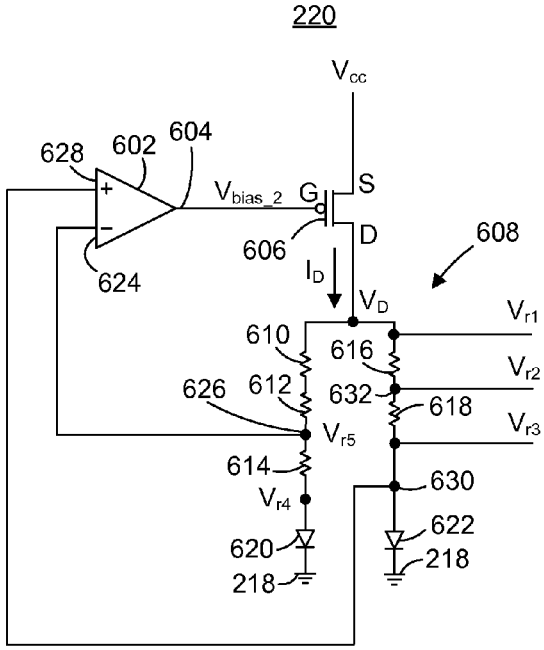
FIG. 6 is a third schematic diagram illustrating a reference circuit in accordance with another embodiment of the present invention.

FIG. 6 is a third schematic diagram illustrating a reference circuit 220 in accordance with another embodiment of the present invention. The reference circuit 220 can include a differential amplifier 602 having an output 604 coupled to a gate of a transistor 606, which also can be embodied as a PMOS transistor, an NMOS transistor, a BJT transistor, or any other suitable transistor. In an arrangement in which the transistor 606 is a PMOS transistor, a source of the transistor 606 can be coupled to the common voltage $V_{cc}$, and a drain of the transistor 606 can be coupled to a bandgap network 608.

The bandgap network 608 can comprise a plurality of resistors 610, 612, 614, 616, 618, and one or more bandgap devices, such as diodes 620, 622. The diodes 620, 622 may be coupled to a suitable ground 218, though this is not a requirement. For instance, the diodes 620, 622 can be coupled between other components of the reference circuit 220. The diodes 620, 622 can provide respective reference voltages $V_{r4}$ and $V_{r3}$. Further, the diode 620 and the resistors 610-614 can form a respective voltage divider network. For example, the resistors 610-614 can be coupled between the output voltage $V_D$ of the transistor 606 and the reference voltage $V_{r4}$ established by the diode 620. Similarly, the diode 622 and the resistors 616, 618 can form a voltage divider network. For instance, the resistors 616, 618 can be coupled between the output voltage $V_D$ of the transistor 606 and the reference voltage $V_{r3}$ established by the diode 622.

An inverting input 624 of the differential amplifier 602 can be coupled to a junction 626 of the resistors 612, 614, thus receiving a reference voltage $V_{r5}$. Further, a non-inverting input 628 of the differential amplifier 602 can be coupled to the junction 630 of the resistor 618 and the diode 622, thus receiving the reference voltage $V_{r3}$ defined at the junction 630. The reference voltage $V_{r1}$ can be equal to the drain voltage $V_D$, and the reference voltage $V_{r2}$ can be defined by the junction 632 of the resistor 616 and the resistor 618. Accordingly, the output 604 of the differential amplifier 602 can apply a bias voltage $V_{bias_2}$ to the gate of the transistor 606. The bias voltage $V_{bias_2}$ can be based on the difference between reference voltage $V_{r3}$ and the reference voltage $V_{r5}$. Accordingly, the bias voltage $V_{bias_2}$ can define the amount of current $I_D$ drawn by the transistor 606. The current $I_D$ and the impedance of bandgap network 608 can define the voltage $V_D$.

In operation, the reference voltages $V_{r3}$, $V_{r5}$ can vary with the temperature of the diodes 620, 622. Hence, the reference voltages $V_{r1}$, $V_{r2}$, $V_{r4}$ also can vary with the temperature of the diodes 620, 622. For example, silicon typically exhibits a negative voltage-temperature coefficient. Thus, as the temperature of the diodes 620, 622 increases, the reference voltages $V_{r3}$, $V_{r5}$ can decrease. When the values of the resistors 610-618 are suitably chosen, the reference voltage $V_{r1}$ can have a positive voltage-temperature coefficient, and the reference voltage $V_{r2}$ can have approximately a zero voltage-temperature coefficient. The reference voltage $V_{r3}$ can have a negative voltage-temperature coefficient corresponding to the diode 622. Of course, the values of the resistors 610-618 also can be chosen such that the reference voltage $V_{r1}$ has a zero voltage-temperature coefficient, and the reference voltage $V_{r2}$ has a negative voltage-temperature coefficient. The values of the resistors 610-618 also can be chosen such that the reference voltages $V_{r1}$, $V_{r2}$ both have negative voltage-temperature coefficients.

At this point it should be noted that the embodiment of the reference circuit 220 depicted in FIG. 6 is but one of a myriad of reference circuits that are suitable for use in the present invention, and thus the invention is not limited to this particular example. Moreover, in addition to the reference circuit 220, a variety of other circuit components can be implemented in the bias control circuit 210 of FIG. 2 to achieve a desired voltage bias $V_{bias}$. For example, gain amplifiers, buffer amplifiers, voltage offset circuits, and/or additional current sinks can be implemented.

Figure 7:
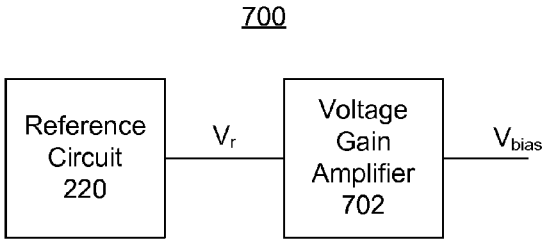
FIG. 7 is a second block diagram illustrating a bias control circuit in accordance with another embodiment of the present invention.

FIG. 7 is a second block diagram illustrating a bias control circuit 700 in accordance with another embodiment of the present invention. In addition to the reference circuit 220 and, optionally, the voltage selector (not shown), the bias control circuit 700 also can include a voltage gain amplifier 702. The voltage gain amplifier 702 can increase or decrease the reference voltage $V_r$ generated by the reference circuit and output the increased or decreased reference voltage $V_r$ as the bias voltage $V_{bias}$.

Figure 8:
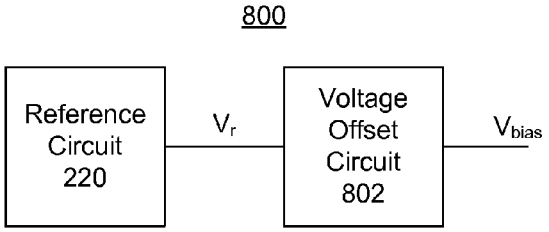
FIG. 8 is a third block diagram illustrating a bias control circuit in accordance with another embodiment of the present invention.

FIG. 8 is a third block diagram illustrating a bias control circuit 800 in accordance with another embodiment of the present invention. In addition to the reference circuit 220 and, optionally, the voltage selector (not shown), the bias control circuit 800 also can include a voltage offset circuit 802. The voltage offset circuit 802 can apply a voltage offset to the reference voltage $V_r$ to generate the bias voltage $V_{bias}$. The offset voltage can be a positive offset voltage or a negative offset voltage. Accordingly, the amplitude of the bias voltage $V_{bias}$ can be adjusted while maintaining the same relationship for change in voltage vs. change in temperature (e.g., slope) as provided by the reference voltage $V_r$.

Figure 9:
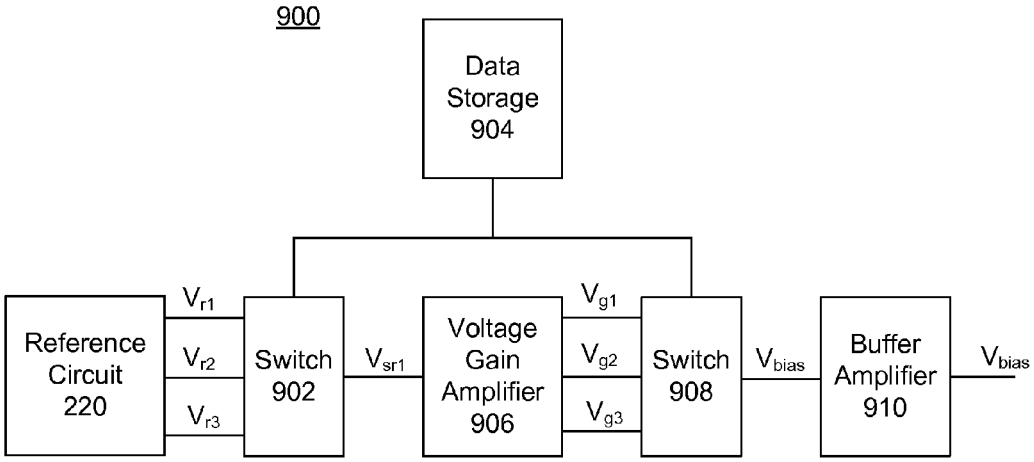
FIG. 9 is a fourth block diagram illustrating a bias control circuit in accordance with another embodiment of the present invention.

FIG. 9 is a fourth block diagram illustrating a bias control circuit 900 in accordance with another embodiment of the present invention. The bias control circuit 900 can include the reference circuit 220 which, as noted, can output one or more reference voltages. In this example, three reference voltages are shown, $V_{r1}$, $V_{r2}$, $V_{r3}$, although any number of reference voltages may be provided. The reference voltages $V_{r1}$, $V_{r2}$, $V_{r3}$ may be configured to have positive voltage-temperature coefficients, zero voltage-temperature coefficients, or negative voltage-temperature coefficients, as previously described.

The bias control circuit 900 also can include a switch 902 to select from among the reference voltages $V_{r1}$, $V_{r2}$, $V_{r3}$ to output a selected reference voltage $V_{sr1}$. In one arrangement, the switch 902 can comprise a multiplexer. A data storage 904 can be provided to provide suitable computer program code (e.g., firmware or software) to the multiplexer. The multiplexer can process the computer program code to select the reference voltage $V_{sr1}$ from among the reference voltages $V_{r1}$, $V_{r2}$, $V_{r3}$. In another arrangement, the switch 902 can comprise a multi-pole, single-throw switch that selects from among the reference voltages $V_{r1}$, $V_{r2}$, $V_{r3}$ and output the reference voltage $V_{sr1}$. In this arrangement, the switch can be controlled by a suitable processing or control circuitry.

A voltage gain amplifier 906 can be provided to selectively apply a plurality of voltage gains to the selected reference voltage $V_{sr1}$ and output a plurality of reference voltages $V_{g1}$, $V_{g2}$, $V_{g3}$ which correspond to the reference voltage $V_{sr1}$, although each of the reference voltages $V_{g1}$, $V_{g2}$, $V_{g3}$ can have a different voltage level. The gains applied by the gain amplifier 906 to the reference voltage $V_{sr1}$ can be less than one, equal to one or greater than one. For example, a gain of less than one can be applied to the reference voltage $V_{sr1}$ to generate the reference voltage $V_{g1}$, a gain of one can be applied to the reference voltage $V_{sr1}$ to generate the reference voltage $V_{g2}$, and a gain of greater than one can be applied to the reference voltage $V_{sr1}$ to generate the reference voltage $V_{g3}$. In other arrangements, different gains of less than one can be applied to the reference voltage $V_{sr1}$ to generate two or more of the reference voltages $V_{g1}$, $V_{g2}$, $V_{g3}$, and/or different gains of greater than one can be applied to the reference voltage $V_{sr1}$ to generate two or more of the reference voltages $V_{g1}$, $V_{g2}$, $V_{g3}$.

The reference voltages $V_{g1}$, $V_{g2}$, $V_{g3}$ can be coupled to a switch 908. The switch 908 can select from among the reference voltages $V_{g1}$, $V_{g2}$, $V_{g3}$ to apply the selected reference voltage $V_{g1}$, $V_{g2}$, $V_{g3}$ as the bias voltage $V_{bias}$. Again, the switch 908 can comprise a multiplexer, and the data storage 904 can provide suitable computer program code to the multiplexer. The multiplexer can process the computer program code to perform the selection of the bias voltage $V_{bias}$ from among the reference voltages $V_{g1}$, $V_{g2}$, $V_{g3}$. In another embodiment, the switch 908 can comprise a multi-pole, single-throw switch that selects one reference voltage from among the reference voltages $V_{g1}$, $V_{g2}$, $V_{g3}$, and outputs the selected reference voltage as the bias voltage $V_{bias}$ that is applied to the current sink 208 of FIG. 2. In this embodiment, the switch can be controlled by a suitable processing or control circuitry.

Optionally, a buffer amplifier 910 can be coupled to the switch 908. The buffer amplifier 910 can receive the bias voltage $V_{bias}$, for example from the switch 908, and apply the bias voltage $V_{bias}$ to the current sink 208 of FIG. 2 while buffering the components 220, 902, 906, 908 from the current sink 208.

Figure 10:
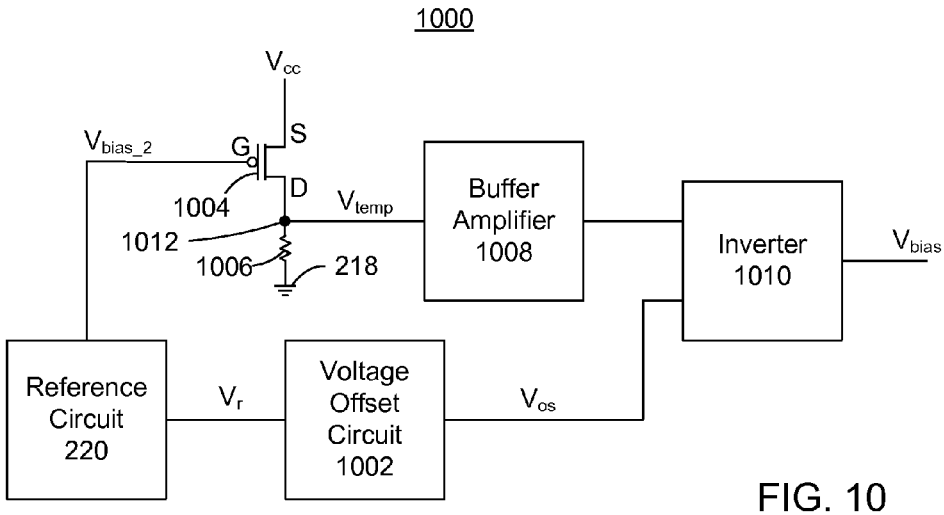
FIG. 10 is a first hybrid schematic and block diagram illustrating a bias control circuit in accordance with another embodiment of the present invention.

FIG. 10 is a first hybrid schematic and block diagram illustrating a bias control circuit 1000 in accordance with another embodiment of the present invention. The bias control circuit 1000 can include the reference circuit 220, a voltage offset circuit 1002, a transistor 1004, a resistor 1006, a buffer amplifier 1008, and an inverter 1010. The transistor 1004 can be a PMOS transistor, and NMOS transistor, a BJT transistor, or any other suitable type of transistor. In an arrangement in which the transistor 1004 is a PMOS transistor, the resistor 1006 can be coupled between the drain of the transistor 1004 and a suitable ground 218. Of course, any other suitable transistor can be used, such as those previously noted.

In this embodiment, the reference voltage $V_r$ can be a voltage generated by the reference circuit which has a voltage-temperature coefficient that is approximately zero. The voltage offset circuit 1002 can apply a voltage offset to the reference voltage $V_r$ to generate an offset voltage $V_{os}$ having a voltage that is lower than the reference voltage $V_r$. The offset voltage $V_{os}$ can be applied to the inverter 1010, for example to a non-inverting input.

A bias voltage $V_{bias_2}$ generated by the reference circuit 220 can be applied to a gate of a transistor 1004. In illustration, the bias voltage $V_{bias_2}$ can be the voltage output by the differential amplifier of FIG. 6. Accordingly, the bias voltage $V_{bias_2}$ can correspond to the temperature of the reference circuit 220, and thus stimulate a temperature voltage $V_{temp}$ to be generated at the junction 1012 of the drain of the transistor 1004 and the resistor 1006. In this regard, the temperature voltage $V_{temp}$ can increase as the temperature of the reference circuit 220 increases.

The temperature voltage $V_{temp}$ can be applied to a buffer amplifier 1008, and the output of the buffer amplifier 1008 can be applied to the inverter 1010, for example to an inverting input. The inverter 1010 can invert the buffered temperature voltage $V_{temp}$ and add to the temperature voltage $V_{temp}$ the offset voltage $V_{os}$ to generate the bias voltage $V_{bias}$. In this embodiment, the bias voltage $V_{bias}$ that is generated can have a negative voltage-temperature coefficient.

Figure 11:
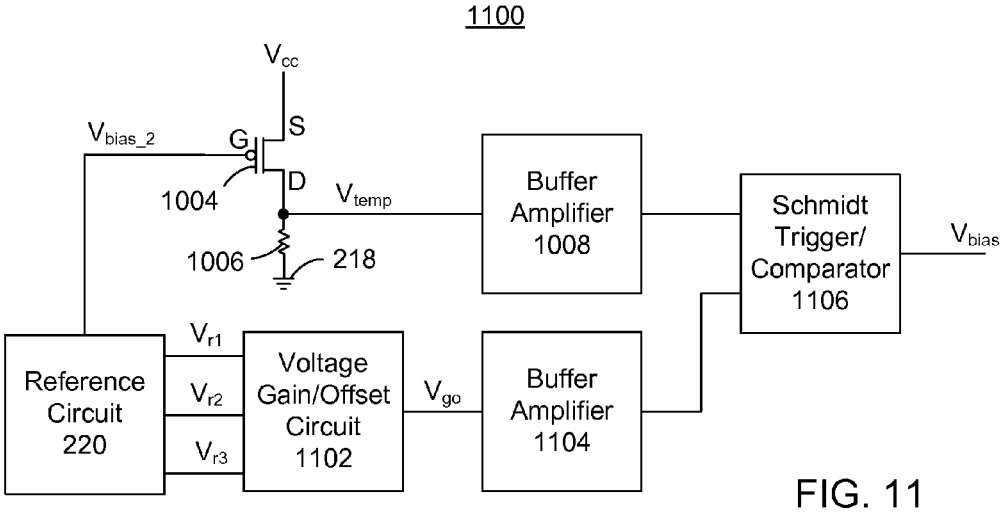
FIG. 11 is a second hybrid schematic and block diagram illustrating a bias control circuit in accordance with another embodiment of the present invention.

FIG. 11 is a second hybrid schematic and block diagram illustrating a bias control circuit 1100 in accordance with another embodiment of the present invention. The bias control circuit 1100 is similar to the bias control circuit 1000 of FIG. 10 in that the bias control circuit 1100 generates the temperature voltage $V_{temp}$ using the transistor 1004 and resistor 1006. The bias control circuit 1100 also can include the reference circuit 220 and the buffer amplifier 1008. In addition, the bias control circuit 1100 further can comprise a voltage gain/offset circuit 1102, a buffer amplifier 1104, and a Schmidt trigger/comparator 1106.

In operation, the voltage gain/offset circuit 1102 can apply a voltage gain and a voltage offset to generate a gain/offset voltage $V_{go}$, and the buffer amplifier 1104 can buffer the gain/offset voltage $V_{go}$. The buffered gain/offset voltage $V_{go}$ and the buffered temperature voltage $V_{temp}$ can be input into the Schmidt trigger/comparator 1106. In this embodiment, the Schmidt trigger/comparator 1106 can compare the buffered temperature voltage $V_{temp}$ to the buffered offset voltage $V_{go}$ and turn off the bias voltage $V_{bias}$ when the temperature of the reference circuit 220, as indicated by the temperature voltage $V_{temp}$, reaches a particular value. Such value can be indicated by the gain/offset voltage $V_{go}$. Accordingly, when the load circuit has reached a suitable operating temperature, the current sink can be turned off, thereby reducing the total amount of power dissipated in the circuit in which the voltage regulator is implemented.

Determination of when the load circuit has reached a suitable operating temperature can be determined by the temperature voltage $V_{temp}$. In this regard, it may be assumed that the temperature of the reference circuit 220 corresponds to the temperature of the load circuit. Such temperature can be reflected by the temperature of one or more bandgap devices within the reference circuit 220. In other words, the level of the bias voltage $V_{bias_2}$ can depend on one or more of the reference voltages generated, such as those generated using bandgap devices, for instance as shown in FIG. 6.

Figure 12:
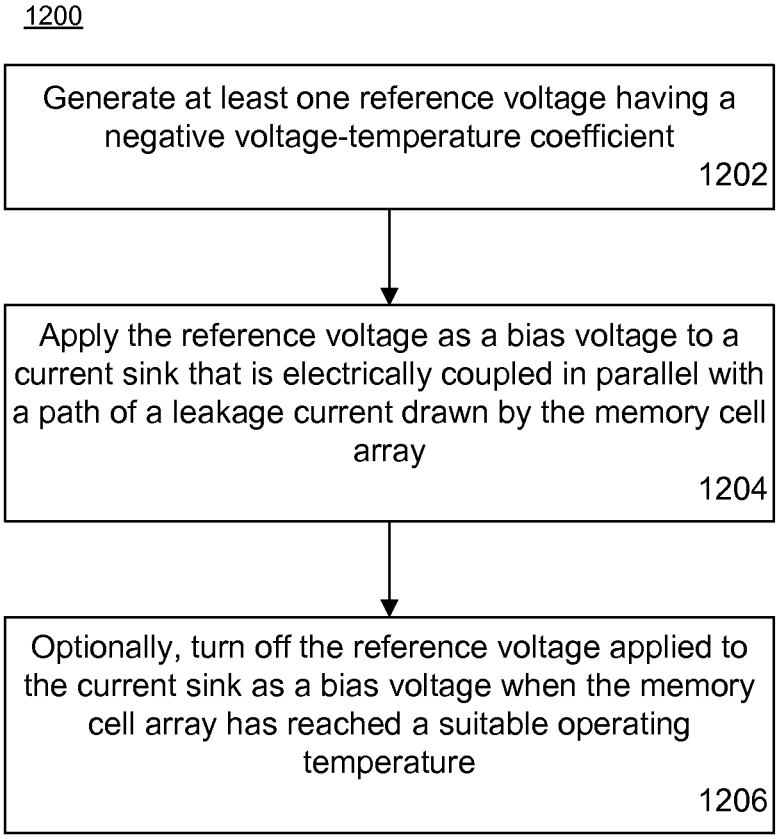
FIG. 12 is a flowchart illustrating a method of regulating a supply voltage in accordance with another embodiment of the present invention.

FIG. 12 is a flowchart illustrating a method 1200 of regulating a supply voltage in accordance with another embodiment of the present invention. In one embodiment, the method 1200 can begin in a state in which the temperature of a load circuit is below the load circuit's normal operating temperature. Nonetheless, the present invention is not limited in this regard. Indeed, the method 1200 can be initiated at the behest of an operator, or in any other suitable manner.

At step 1202, at least one reference voltage can be generated. In one embodiment, the reference voltage can have a negative voltage-temperature coefficient. For example, a plurality of reference voltages can be generated, and at least one of these reference voltages can be selected.

At step 1204, the reference voltage can be applied as a bias voltage to a current sink that is electrically coupled in parallel with a path of a leakage current drawn by the load circuit. For example, the reference voltage can be applied on an n-channel MOSFET transistor. In one embodiment, the current can have a negative current-temperature coefficient.

The reference voltage can indicate to the current sink to draw a current from a voltage supply to maintain a total current supplied by the voltage supply within a suitable operating range of the voltage supply. The total current supplied by the voltage supply can be approximately equal to the current drawn by the current sink and the leakage current drawn by the load circuit.

Optionally, at step 1206, the reference voltage that is applied to the current sink as a bias voltage can be turned off when the load circuit has reached a suitable operating temperature.

The flowcharts in the figures illustrate the architecture, functionality, and operation of possible implementations of systems, methods and computer program products according to various embodiments of the present invention. In this regard, each block in the flowcharts may represent a module, segment, or portion of code, which comprises one or more portions of computer-usable program code that implements the specified logical function(s).

It should be noted that, in some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It also should be noted that each block of the flowchart illustrations, and combinations of blocks in the flowchart illustrations, can be implemented by special purpose hardware-based systems that perform the specified functions or acts, or combinations of special purpose hardware and computer instructions.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising, i.e., open language. The term "coupled," as used herein, is defined as connected, although not necessarily directly, and not necessarily mechanically, e.g., communicatively linked through a communication channel or pathway or another component or system.

The embodiments disclosed herein can be embodied in other forms without departing from the spirit or essential attributes thereof. Accordingly, reference should be made to the following claims, rather than to the foregoing specification, as indicating the scope of the various embodiments of the present invention.

What is claimed is:

1. A method of regulating a supply voltage provided to a load circuit, comprising:

applying a voltage gain to a first reference voltage by a voltage gain amplifier and outputting a plurality of second reference voltages;

selecting, with a switch, one of the second reference voltages as a third reference voltage, the third reference voltage having a negative voltage-temperature coefficient;

applying the third reference voltage as a bias voltage to a current sink that is electrically coupled in parallel with a path of a leakage current drawn by the load circuit; and turning off the reference voltage applied to the current sink as the bias voltage in response to the load circuit reaching an operating temperature;

wherein the current sink is turned off in response to turning off the reference voltage applied to the current sink.

2. The method of claim 1, wherein applying the reference voltage to a current sink as a bias voltage comprises:

applying the third reference voltage to an n-channel MOSFET transistor.

3. The method of claim 1, wherein applying the third reference voltage to the current sink as the bias voltage comprises;

indicating to the current sink to draw a current from a voltage supply in order to maintain a total current supplied by the voltage supply within an operating range of the voltage supply.

4. The method of claim 3, wherein drawing current from the voltage supply to maintain the total current supplied by the voltage supply within the operating range of the voltage supply comprises:

drawing the current to exhibit a negative current-temperature coefficient.

5. The method of claim 3, wherein:

the total current supplied by the voltage supply is approximately equal to the current drawn by the current sink and the leakage current drawn by the load circuit.

6. A voltage regulator, comprising:

a current sink that is electrically coupled in parallel with a path of a leakage current drawn by a load circuit;

a bias control circuit that generates at least a first reference voltage having a negative voltage-temperature coefficient and applies the first reference voltage as a bias voltage to the current sink;

wherein the bias control circuit comprises:

a voltage gain amplifier that applies a voltage gain to a second reference voltage and outputs a plurality of third reference voltages; and a switch that selects one of the third reference voltages from among the plurality of third reference voltages as the first reference voltage that is applied as the bias voltage to the current sink;

wherein the bias control circuit is configured to turn off the first reference voltage applied to the current sink as the bias voltage in response to the load circuit reaching an operating temperature; and wherein the current sink is turned off in response to the bias control circuit turning off the first reference voltage.

7. The voltage regulator of claim 6, wherein:

the current sink comprises an n-channel MOSFET transistor.

8. The voltage regulator of claim 6, wherein:

the first reference voltage indicates to the current sink to draw a current from a voltage supply in order to maintain a total current supplied by the voltage supply within an operating range of the voltage supply.

9. The voltage regulator of claim 8, wherein:

the current from the voltage supply drawn by the current sink exhibits a negative current-temperature coefficient.

10. The voltage regulator of claim 8, wherein:

the total current supplied by the voltage supply is approximately equal to the current drawn by the current sink and the leakage current drawn by the load circuit.

11. The voltage regulator of claim 6, wherein:

the bias control circuit further comprises at least one circuit selected from a group consisting of a Schmidt trigger and a comparator.

12. The voltage regulator of claim 6, further comprising:

a voltage gain amplifier that increases or decreases the first reference voltage.

13. The voltage regulator of claim 6, further comprising:

a voltage offset circuit that applies a voltage offset to the first reference voltage to generate an offset voltage;

a p-channel MOSFET transistor that generates a temperature voltage; and an inverter that inverts the temperature voltage and adds to the temperature voltage the offset voltage to generate the bias voltage, wherein the bias voltage has a negative voltage-temperature coefficient.

14. The voltage regulator of claim 6, further comprising:

a voltage supply that supplies a supply voltage to the load circuit.

15. The voltage regulator of claim 6, wherein:

the bias control circuit comprises a bandgap circuit.

16. A regulator, comprising:

a voltage supply circuit configured and arranged to generate a regulated voltage based on a reference voltage and provide the regulated voltage to a load circuit coupled to an output of the regulator;

a current sink coupled to the output of the regulator and configured and arranged to sink current from the output of the regulator to a ground voltage in response to a bias voltage; and a bias control circuit configured to:

generate a first reference voltage having a negative voltage-temperature coefficient and provide the first reference voltage to the current sink as the bias voltage; and turn off the first reference voltage applied to the current sink as the bias voltage in response to the load circuit reaching an operating temperature;

wherein:

the current sink is further configured and arranged to turn off in response to the bias control circuit turning off the first reference voltage; and the voltage supply circuit provides a non-varying current in response to changes in operating temperature.

* * * * *